United States Patent [19]

Aleem-Uddin

[11] Patent Number: 4,997,598

[45] Date of Patent: Mar. 5, 1991

[54] VAPORIZING DEVICE AND METHOD

[76] Inventor: Mustafa Aleem-Uddin, 45 - Thorn Lane, Bradford, West Yorkshire BD9 6NB, United Kingdom

[21] Appl. No.: 457,704

[22] PCT Filed: Jun. 28, 1988

[86] PCT No.: PCT/GB88/00508

§ 371 Date: Feb. 6, 1990

§ 102(e) Date: Feb. 6, 1990

[87] PCT Pub. No.: WO89/00240

PCT Pub. Date: Jan. 12, 1989

[30] Foreign Application Priority Data

Apr. 3, 1987 [GB] United Kingdom ..... 8715704

[51] Int. Cl.[5] ..... B01F 3/04

[52] U.S. Cl. ..... 261/95; 261/96; 261/97

[58] Field of Search ..... 261/95, 96, 97

[56] References Cited

U.S. PATENT DOCUMENTS

| | | | |
|---|---|---|---|
| 1,857,565 | 5/1932 | Pahl et al. | 261/95 |
| 2,149,460 | 3/1939 | Muller | 261/95 |
| 3,352,545 | 11/1967 | Denine | 261/95 |
| 4,486,362 | 12/1984 | Forster et al. | 261/95 |

FOREIGN PATENT DOCUMENTS

| | | |
|---|---|---|
| 574654 | 4/1924 | France . |
| 2391368 | 12/1978 | France . |
| 333906 | 8/1930 | United Kingdom . |
| 631727 | 11/1949 | United Kingdom . |
| 1593199 | 7/1981 | United Kingdom . |

*Primary Examiner*—Tim Miles

*Attorney, Agent, or Firm*—Reising, Ethington, Barnard, Perry & Milton

[57] ABSTRACT

A vaporizing nozzle comprises a wall of porous material, for example sintered bronze, through which the liquid to be evaporated percolates. The liquid may be, for example, petrol. At the other side of the wall the liquid atomizes or vaporizes into a gas stream, for example an air stream. The nozzle therefore provides a simple and convenient way of vaporizing or atomizing a liquid within a gas stream in, for example, the vaporization of petrol into an air stream for use with internal combustion engines. The nozzle includes selectively closed machined portions for altering the flow characteristics of the material.

8 Claims, 6 Drawing Sheets

VAPORIZING DEVICE AND METHOD

FIELD OF INVENTION

This invention relates to a vaporising device and in particular relates to a device useful in evaporating liquid into gaseous streams for example liquid fuels into an air stream.

BACKGROUND OF INVENTION

In internal combustion engines, turbines, liquid fuel fired furnaces, and the like, liquid fuel is mixed with an oxidising gas stream, for example an air stream. In a conventional fuel/air mixing device such as a carburettor the fuel discharges from a jet or metering bar in a stream which is torn apart into ligaments which progressively break up and contract into droplets of various sizes. During this process vaporisation takes place and the droplets progressively reduce in size the finest vaporising completely. Ideally, all of the liquid droplets would be vaporised and uniformly distributed in the air stream by the time they reach the combustion zone or combustion chamber.

In practice, especially under the varying conditions which internal combustion engines in particular are subjected to, some of the droplets are incompletely vaporised and this has adverse effects on both fuel economy and the cleanliness of the exhaust gases. In most conventional devices such as carburettors complete vaporisation only occurs at some part throttle conditions. Furthermore vaporisation occurs at a substantial distance away from the point of fuel discharge which distance varies with variable fuel demands of the engine. Fuel vaporasation is improved with forced fuel injection systems where the fuel injection nozzle functions to mechanically atomise the fuel at the tip exposed to the air stream. Fuel injection has several advantages over conventional carburettors but suffers from the disadvantages of high manufacturing costs and additional complexity requiring more sophisticated servicing.

The invention seeks to provide a form of vaporising device improved in the above respects.

SUMMARY OF INVENTION

According to the present invention there is provided a vaporising device which comprises a nozzle located in a gaseous stream such that a small portion of the stream passes through the nozzle, the nozzle comprising a wall of porous material being a sintered metal through which the liquid to be vapourised percolates from one side thereof into the gas stream through the nozzle and wherein the surface of the sintered metal is selectively closed by machined portions of the surface thereof.

The porous material is a sintered metal, in particular brass, bronze, cupro-nickel or the like. Conveniently, the wall will be cylindrical in configuration and the gas stream may flow over the cylinder, in which case the liquid will be supplied internally of the cylinder, or may flow through the cylinder, in which case the liquid will be supplied externally of the cylinder.

The primary use of the device of the invention is envisaged to be in mixing hydrocarbon fuels with an air stream, for use in for example an internal combustion engine, and the terms 'fuel' and 'air stream' will be used hereafter but it will be appreciated that the device of the invention is useful wherever a liquid is to be evaporated in to a gas stream.

In a preferred form of manufacturing a device in accordance with the invention the applicants have utilised a property of sintered non-ferrous metals hitherto regarded as a disadvantage. A sintered metal tube or cylinder, for example of a type available for use in filtration systems, cannot normally be machined since machining of the sintered metal surface causes the porous porosity of the surface to be lost since the physical cutting action of the machine tool causes the spherical grains of the sintered material to flatten and close the interstices. Thus, by selectively machining portions of a cylinder of sintered material the surface area can be varied at will. Thus, as will be described more fully heriafter, the flow characteristics of a cylinder of sintered material can be altered to provide a nozzle having the necessary fuel delivery characteristics for a particular end use.

FIGURES IN THE DRAWINGS

The invention will be described further, by way of example, with reference to the accompanying drawings, in which.

PREFERRED EMBODIMENT

Figure 1A:
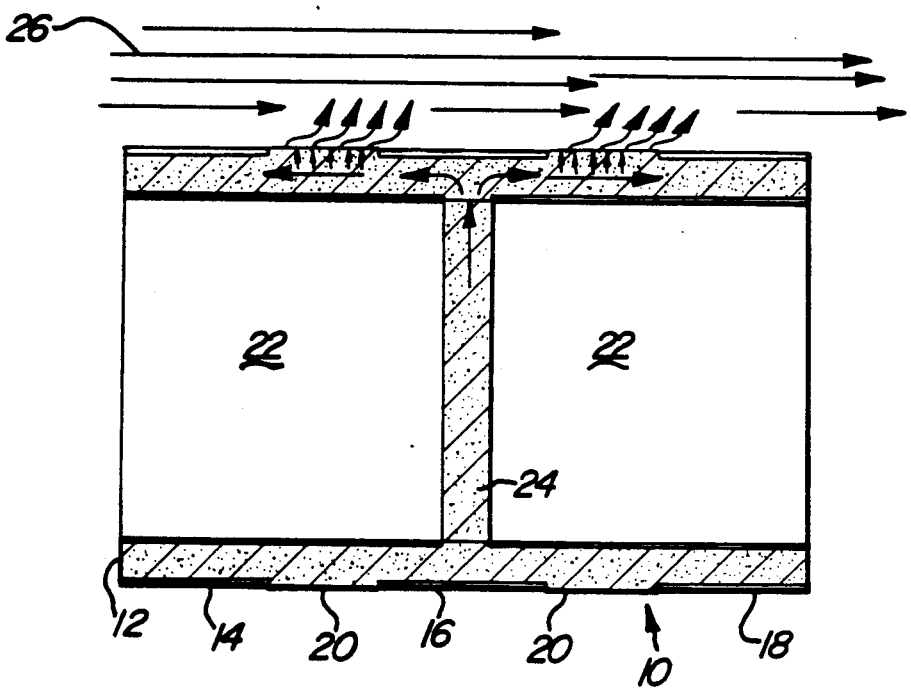
FIG. 1 is a diagrammatic sectional and plan view of the nozzle of a device in accordance with the invention.
Figure 1B:
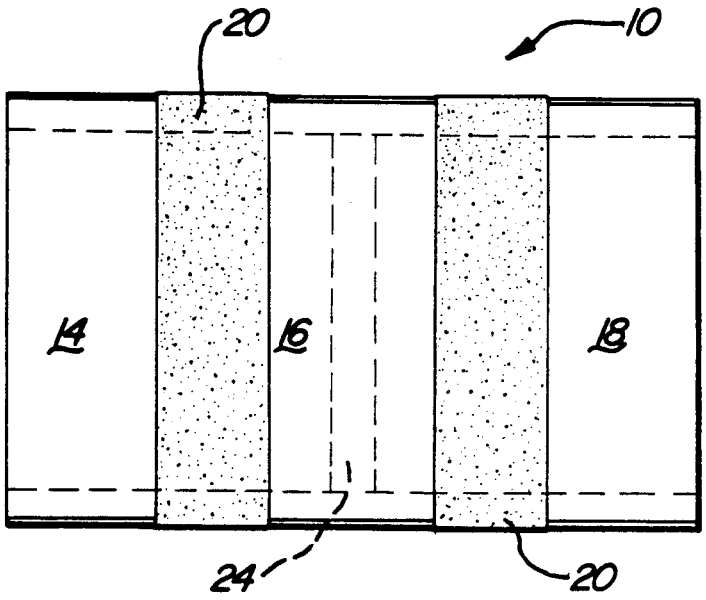

Referring to the drawings, FIG. 1 illustrates the basic principle of the device of the invention. In this, a nozzle generally designated 10 comprises a cylinder of sintered material such as bronze 12. The cylinder 12 is machined on its external surface at 14, 16 and 18 employing a small depth of cut. A cutting depth of 1/100th of an inch or less has been found to be adequate for sintered bronze of grain size from 2.½ to 5 microns. The machining effectively closes the porous surface at 14, 16 and 18. The two unmachined portions 20 remain porous. Similarly, internally of the cylinder, portions 22 are machined leaving porous the portion 24.

Figure 2:
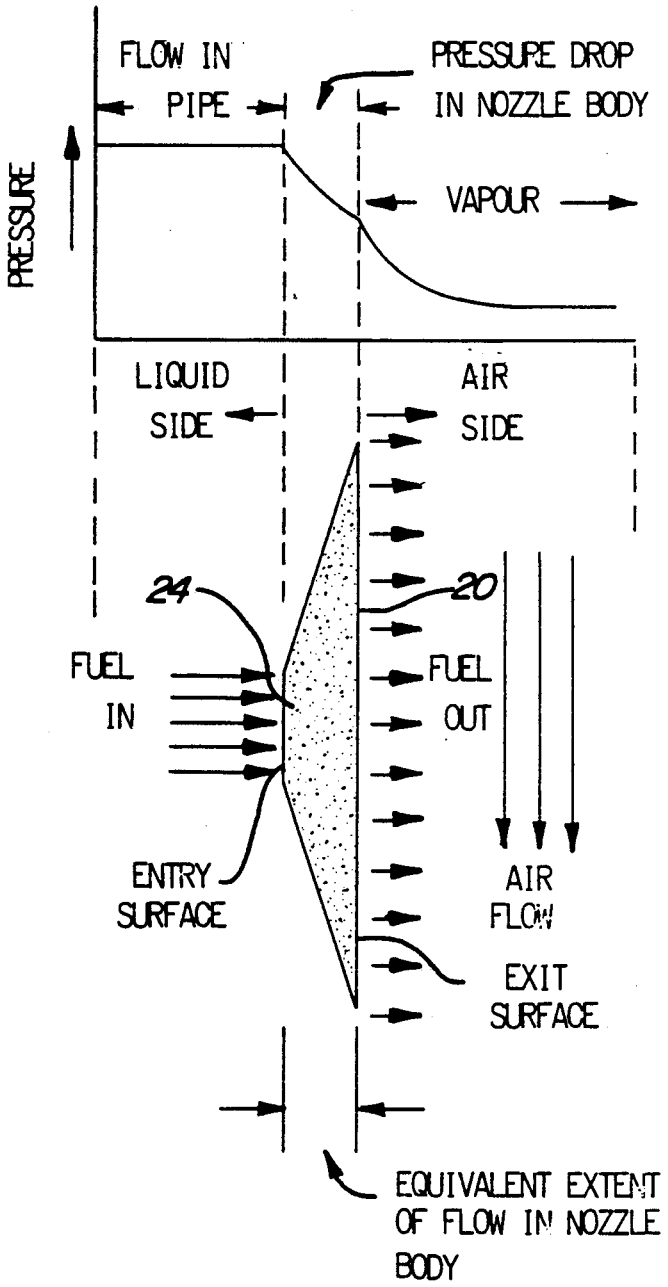
FIG. 2 is a diagrammatic representation of the properties of the nozzle of FIG. 1.

The axial width of the portion 24 is calculated in relation to the internal diameter of the cylinder, the porosity of the porous material, and the fuel requirements so as to allow sufficient fuel to percolate through towards the outer wall surface. Fuel is fed internally of the nozzle 10 from either end, the other end being blocked off, and passes through the strip portion 24 into the porous wall 12 as indicated by the arrow. Since the porous external surfaces 20 are offset with respect to the internal surface 24 there is some axial movement of the fuel before it reaches the porous surface portions 20 where it escapes to the air stream indicated at 26. It will be observed that the total surface area of the exit portions 20 is considerably greater than that of the fuel inlet portion 24 and this is illustrated diagrammatically in FIG. 2 where the pressure drop in the nozzle body is illustrated graphically. Thus the fuel is presented to a large porous surface area in the air stream 26 and therefore enters the air stream 26 in the form of a multiplicity of extremely fine droplets which rapidly vaporise.

In order to obtain the correct fuel/air ratio it is not necessary to pass the total air stream over the nozzle and indeed only a small portion of the air stream will be passed over the nozzle and the resultant rich air/fuel mixture will then be mixed with further air before moving into the combustion zone. One advantage of this arrangement is that if it is necessary, for example in the case of heavier fuels such as paraffins and diesel fuels, to aid evaporation by heating either the air stream, passing through the nozzle 26, or the nozzle casing 40. Then the whole of the air stream need not be heated but only the small proportion passing over the nozzle. Thus the heating requirements are far less than would otherwise be the case and volumetric efficiency of the engine is thereby improved.

Fuel is drawn from the nozzle in a similar manner to the way in which it is drawn from the jet of a conventional carburettor. However, in the latter case, fuel leaves the jet in the form of a stream which must be broken up and atomised in the air stream, fuel leaves the nozzle 26 already in the form of fine droplets and vapour since it is leaving a surface much larger than the entry surface.

Figure 3:
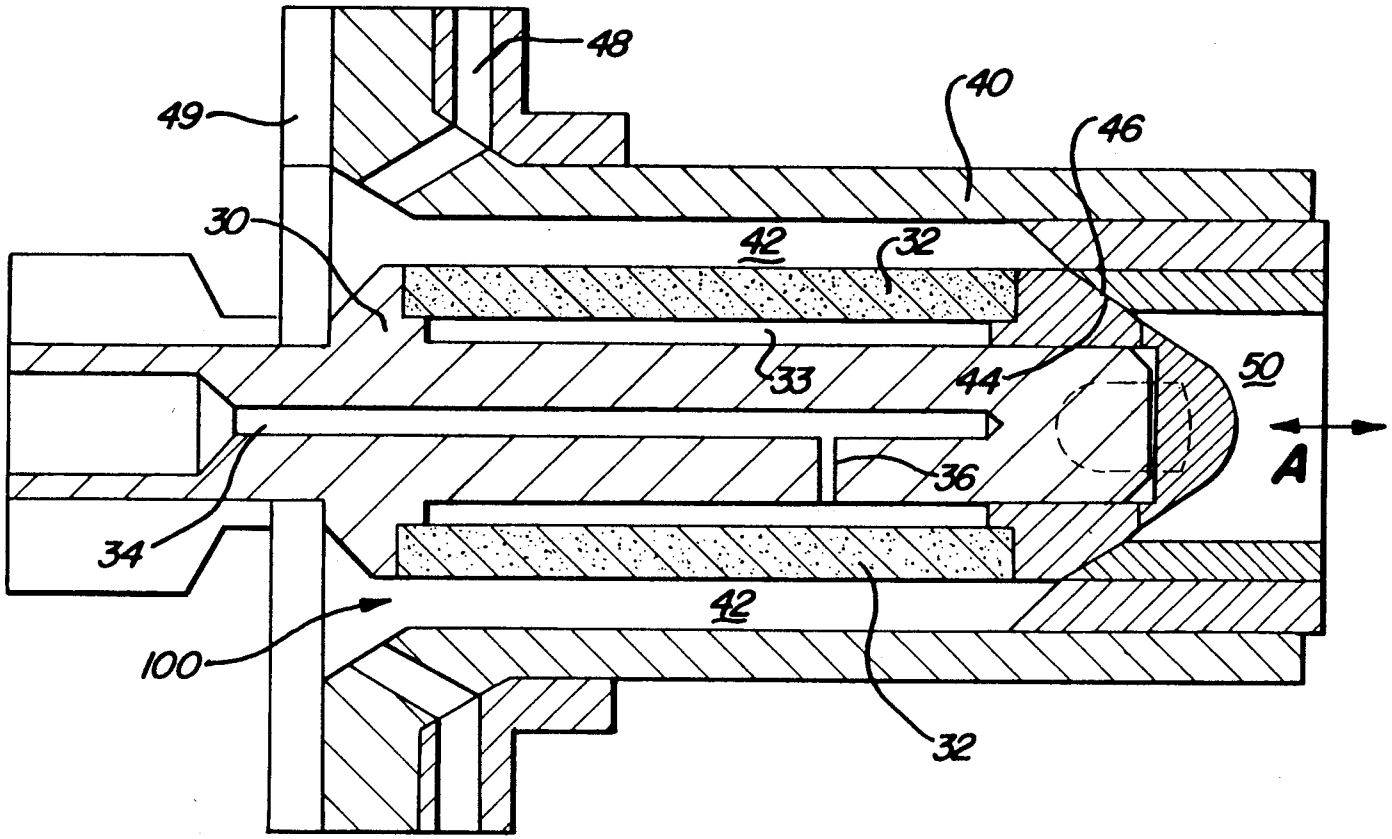
FIG. 3 is a sectional view of an embodiment of the device of the invention for supplying fuel to an internal combustion engine.

Referring now to FIG. 3 an embodiment of the invention suitable for use with an internal combustion engine is shown in more detail.

In this case the nozzle generally designated 100 comprises a body 30 within which is included a cylindrical portion 32 of porous sintered material. Within the body 30 is a fuel supply line 34 connected by means of one or more passageways 36 to an annular space 38 immediately adjacent the inner surface of the porous cylinder 32. The cylinder 32 will have been machined in a like manner to that described with respect to FIG. 1 in accordance with the operating requirements of the engine with which the nozzle is to be used. The nozzle 100 is mounted within a housing 40 which defines an air space 42 between the inner surface of the housing and the outer surface of the cylinder 32. The forward end of the nozzle 100 is provided with an inclined surface 44 adapted to mate with a complementary surface 46 within the housing 40. Movement of the nozzle body backwards and forwards as represented by arrow A moves the nozzle 100 into and out of engagement with the surface 46 thereby accurately metering the flow of fuel/air mixture from the space 42. Air is fed to the space 42, for example via variable excess air passages 48 and an air inlet diffuser 49, and fuel/air mixture leaves the housing 40 at exit 50. The diffuser 49 comprises a porous disc fitted to the inlet end of the housing 40. The purpose of the diffuser 49 is to provide a uniform envelope of air around the cylindrical portion 32. The passage 48 are variable and may be used to adjust the excess air supply.

The device of FIG. 3 is mounted in the inlet manifold of an internal combustion engine. Air is fed via the inlets 48 to the annular space 42 where it passes over the external surface of the porous cylinder 32 entraining droplets of fuel. The fuel/air mixture passes through the gap between the surfaces 44 and 46 and leaves via the exit 50 on route to the combustion zone. Fuel is passed through the fuel inlet 34 and passage or passages 36 into the annular space 38 where it percolates, as described more fully in relation to FIG. 1 above, through to the exit surfaces in the air stream. The speed of the air stream, and therefore the pressure drop caused by it, will vary the amount of fuel drawn in a similar manner to a conventional carburettor. The amount of fuel and air flow is regulated by moving the nozzle 100 backwards and forwards and therefore varying the gap between the mating surfaces 44 and 46. As shown in FIG. 3 the mating surfaces are in contact with each other shutting off the fuel/air flow completely. The mechanism for moving the nozzle body is not illustrated but this may be accomplished in any suitable manner, for example in a similar manner to a poppet valve.

Figure 4:
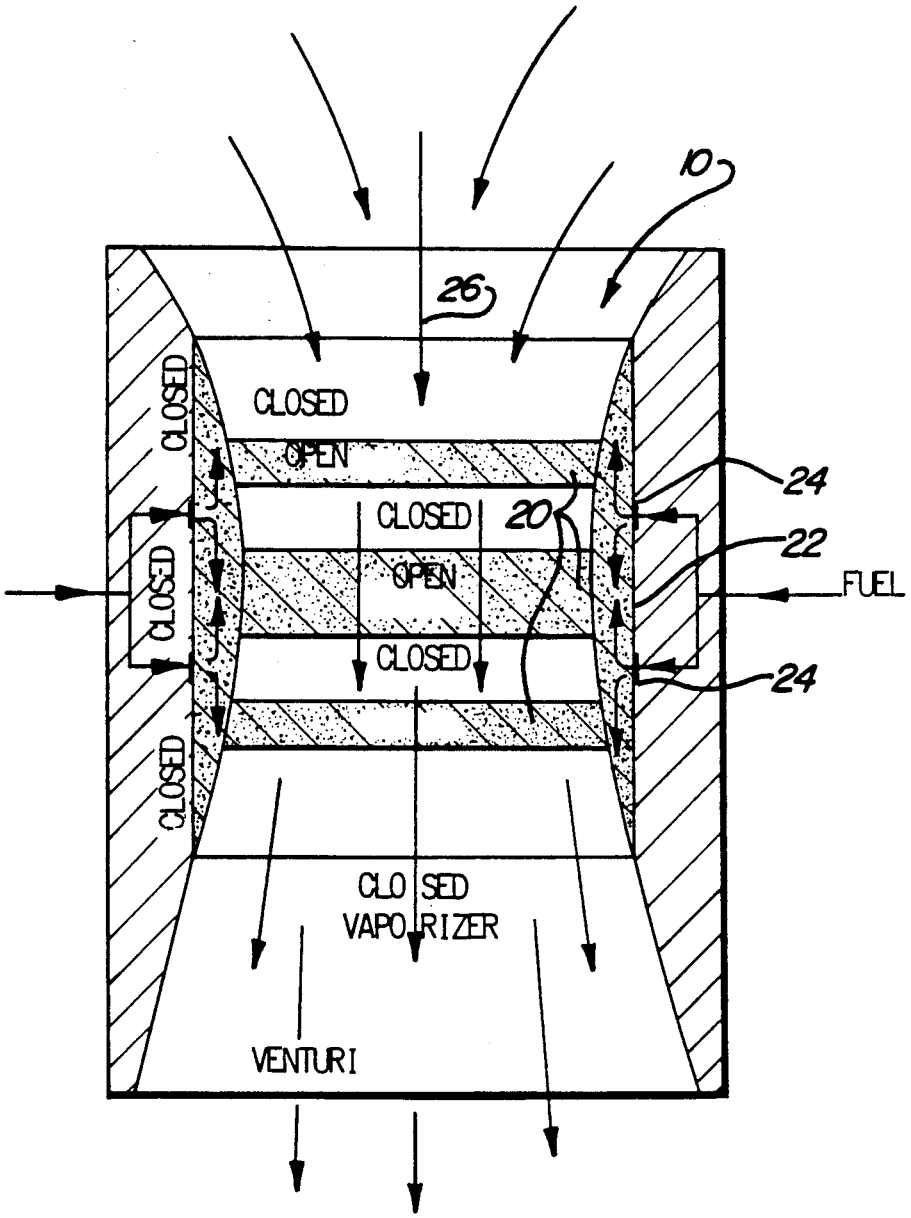
FIG. 4 is a diagrammatic view of a further embodiment.

FIG. 4 illustrates a form of nozzle where a machined cylinder of sintered material is inserted within a venturi. In this case the air flow is internally of the cylinder and the fuel is supplied to the external surface.

Figure 5:
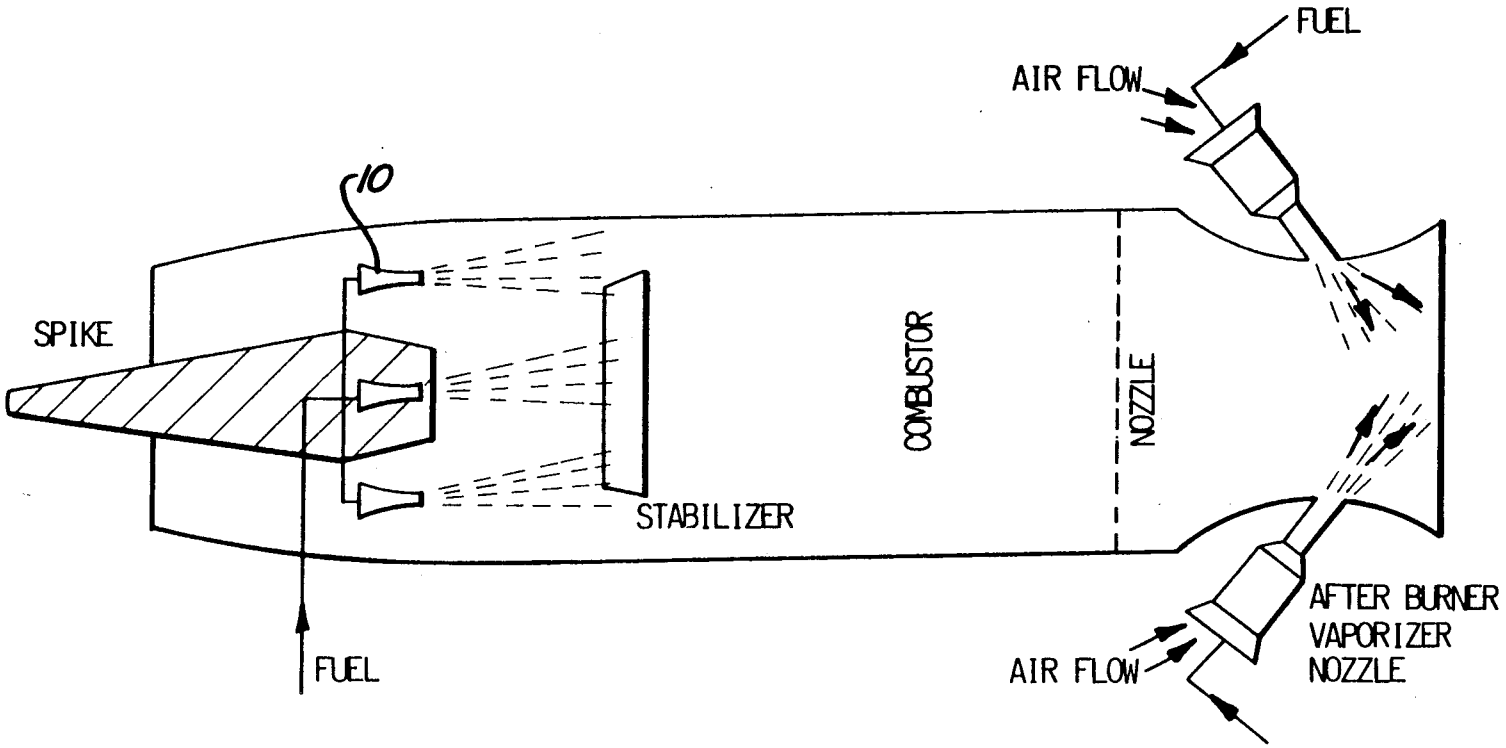
FIG. 5 is a diagrammatic representation of an application of the device of the invention in a ramjet combustor.

In FIG. 5 a ring of devices 10 in accordance with the invention is illustrated in a ramjet combuster. After burner jets are provided which may also be in accordance with the invention.

Figure 6:
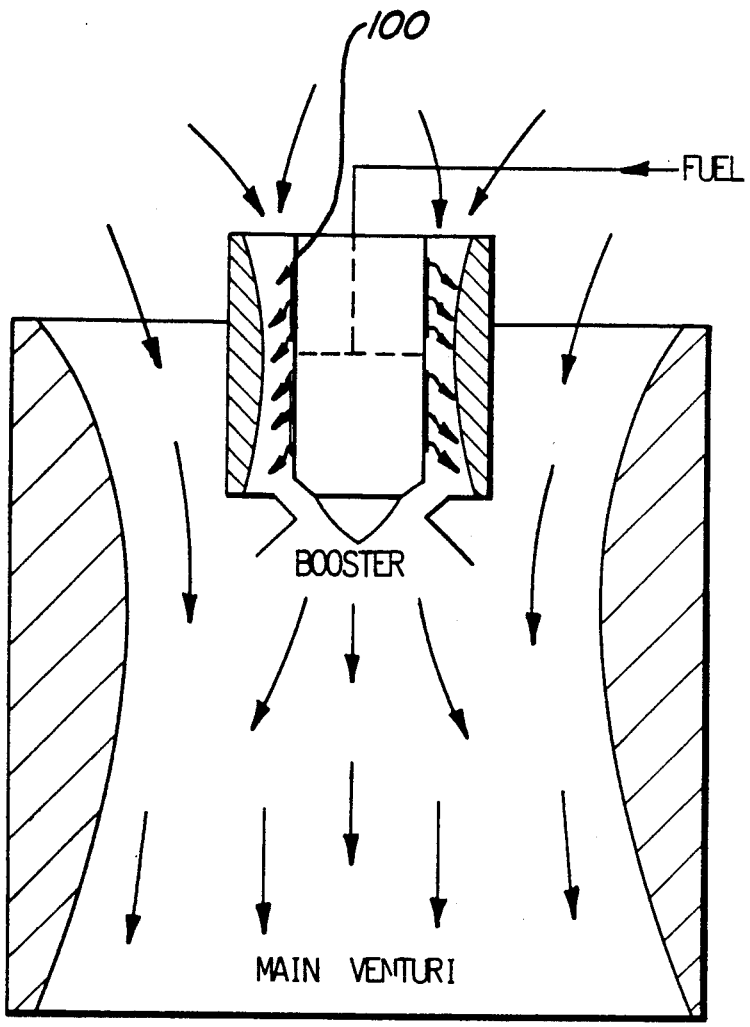
FIG. 6 is a diagrammatic representation of a device of the invention in a booster venturi.

Yet another application is illustrated in FIG. 6 where a jet in accordance with the invention is incorporated into a booster venturi. The jet 100 is similar to that illustrated in FIG. 3 but is located within a booster venturi in turn within a main venturi. Once again the operation is a before.

It has been found that sintered materials of various pore sizes are useful in the facts of the invention. Pore sizes of 2.5 and 5 micrometer have been found suitable for applications in which petrol is the fuel concerned whereas materials having a pore size of 12.5 micrometers are more suitable for the heavier fuels such as diesel. Particularly for sintered materials with larger pore sizes, machining may not completely close off the porosity of the surface. In these circumstances it may be necessary to use additional sealing such as solder or chemical sealing compounds such as adhesives.

The devices of the invention can be used as a replacement for the jets in conventional carburettors but with their faster vaporisation characteristics they may advantageously be located closer to the combustion zones or engine cylinders. Thus one or more devices of the invention may advantageously be located adjacent the cylinder of a multicylinder internal combustion engine. In this configuration the devices of the invention give a similar performance to fuel injection systems but at a considerably lower cost. The fast vaporisation of the nozzle ensures easy starting of any internal combustion engine with which they are fitted and also more complete combustion lessening pollution products in the engine exhaust. The devices of the invention may also be used with advantage in other burning situations such as liquid fuel fired furnaces, turbines and the like including cryogenic applications for example in rockets.

I claim:

1. A vaporising device which comprises a nozzle located in a gaseous stream such that a small portion of the stream passes through the nozzle, the nozzle comprising a wall of porous material being a sintered metal through which the liquid to be vapourised percolates from one side thereof into the gas stream through the nozzle, said material having a surface, and wherein the surface of the sintered metal includes selectively closed machined portions for altering the flow characteristics of said material.

2. A device as claimed in claim 1 in which the wall is cylindrical in configuration and the portion of the gas stream flows over the cylinder, with the liquid being supplied internally of the cylinder.

3. A device as claimed in claim 1 in which the area selected for machining is chosen to suit the characteristic desired for evaporating a particular liquid into the gas stream.

4. A device as claimed in claim 1 wherein the porous material is a sintered metal having spherical grains.

5. A device as claimed in claim 4 in which the sintered metal is bronze of a grain from two-and-a-half to five microns.

6. A device as claimed in claim 1 in which the metal is non-ferrous.

7. A device as claimed in claim 6 in which the metal is brass, bronze or cupro-nickel.

8. A method of forming a vaporizing device, said method including the steps of: forming a wall having a surface of porous material of sintered metal having predetermined flow characteristics, and altering the flow characteristics by machining selective portions of the surface closed.

* * * * *